United States Patent [19]

Sakurai

[11] Patent Number: 4,684,270

[45] Date of Patent: Aug. 4, 1987

[54] PRINT ELEMENT, PRINTER AND METHOD OF PRINTING

[75] Inventor: Yoshiyuki Sakurai, Shiojiri, Japan

[73] Assignee: Seiko Epson Kabushiki Kaisha, Japan

[21] Appl. No.: 720,332

[22] Filed: Apr. 5, 1985

[30] Foreign Application Priority Data

Apr. 6, 1984 [JP] Japan ..... 59-68649
Apr. 6, 1984 [JP] Japan ..... 59-68650

[51] Int. Cl.[4] ..... B41J 1/30; B41J 3/12

[52] U.S. Cl. ..... 400/121; 101/93.04; 400/144.2; 400/174

[58] Field of Search ..... 400/121, 144.2, 174, 400/175; 101/93.04, 93.12, 93.19

[56] References Cited

U.S. PATENT DOCUMENTS 3,283,702 11/1966 Higgins ..... 101/93.04
3,858,509 1/1975 Grundherr ..... 400/144.2 X
4,106,611 8/1978 Suzuki ..... 400/174 X

FOREIGN PATENT DOCUMENTS 215362 12/1983 Japan ..... 400/144.2

OTHER PUBLICATIONS

*IBM Tech. Disc. Bulletin,* by K. P. Eswaran, vol. 21, No. 5, Oct. 1978, p. 2000.
*IBM Tech. Disc. Bulletin,* by A. F. Higginbotham, vol. 22, No. 10, Mar. 1980, pp. 4345–4347.
*IBM Tech. Disc. Bulletin,* by W. G. Anderson, vol. 27, No. 6, Nov. 1984, p. 3644.

*Primary Examiner*—Paul T. Sewell
*Attorney, Agent, or Firm*—Blum Kaplan

[57] ABSTRACT

A serial print element for use with a serial matrix font type printer for printing dot matrix type graphics with a serial matrix font type printer and a method of printing dot matrix graphics with a serial matrix font type printer. The print element includes a carrier for supporting type elements. The print element is coupled to the carrier and is capable of printing at least graphics images formed of dot patterns. The print elements include at least one dot pattern segment series of at least two dots in length. Each of the dot pattern segment series includes a type element on the carrier for each printable dot pattern combination. As a result, dot matrix type graphics can be printed by a serial matrix font type printer. In addition, the print element can contain ASCII character type elements to allow both graphics and character printing with the same print element.

31 Claims, 14 Drawing Figures

| | Hex No. | 0 | 1 | 2 | 3 | 4 | 5 | 6 | 7 |
|---|---|---|---|---|---|---|---|---|---|
| Hex. No. | Binary No. | 0000 | 0001 | 0010 | 0011 | 0100 | 0101 | 0110 | 0111 |
| 0 | 0000 | 0 | 16 | SP 32 | 0 48 | @ 64 | P 80 | ` 96 | p 112 |
| 1 | 0001 | 1 | DC1 17 | ! 33 | 1 49 | A 65 | Q 81 | a 97 | q 113 |
| 2 | 0010 | 2 | DC2 18 | " 34 | 2 50 | B 66 | R 82 | b 98 | r 114 |
| 3 | 0011 | 3 | DC3 19 | # 35 | 3 51 | C 67 | S 83 | c 99 | s 115 |
| 4 | 0100 | 4 | DC4 20 | $ 36 | 4 52 | D 68 | T 84 | d 100 | t 116 |
| 5 | 0101 | 5 | 21 | % 37 | 5 53 | E 69 | U 85 | e 101 | u 117 |
| 6 | 0110 | 6 | 22 | & 38 | 6 54 | F 70 | V 86 | f 102 | v 118 |
| 7 | 0110 | BEL 7 | 23 | ' 39 | 7 55 | G 71 | W 87 | g 103 | w 119 |
| 8 | 1000 | BS 8 | CAN 24 | ( 40 | 8 56 | H 72 | X 88 | h 104 | x 120 |
| 9 | 1001 | HT 9 | 25 | ) 41 | 9 57 | I 73 | Y 89 | i 105 | y 121 |
| A | 1010 | LF 10 | 26 | * 42 | : 58 | J 74 | Z 90 | j 106 | z 122 |
| B | 1011 | VT 11 | ESC 27 | + 43 | ; 59 | K 75 | [ 91 | k 107 | { 123 |
| C | 1100 | FF 12 | 28 | , 44 | < 60 | L 76 | \ 92 | l 108 | ¦ 124 |
| D | 1101 | CR 13 | 29 | - 45 | = 61 | M 77 | ] 93 | m 109 | } 125 |
| E | 1110 | SO 14 | 30 | . 46 | > 62 | N 78 | ^ 94 | n 110 | ~ 126 |
| F | 1110 | SI 15 | 31 | / 47 | ? 63 | O 79 | _ 95 | o 111 | DEL 127 |

FIG. 4

PRINT ELEMENT, PRINTER AND METHOD OF PRINTING

BACKGROUND OF THE INVENTION

The present invention is generally directed to matrix type font printers capable of graphics printing and in particular to a matrix type font printer capable of printing high speed and quality bit addressable graphics.

Conventional serial printers with a matrix type font utilize the puntuation mark "." (the period), which is included as one of the font characters for printing graphics. The period is printed either in successive spaces or partially superimposed as the carriage is moved to draw a horizontal line. In addition, successive periods may be printed in successive vertical spaces or partially vertically superimposed to draw a vertical line. This is achieved by feeding the paper while the carriage is held at rest. Lines which are either horizontal or vertical are achieved by moving the carriage and feeding paper at the same time. Graphics patterns can be printed by combining these lines. Graphics printers with a matrix type font have achieved graphics printing by reducing a graphics image to be displayed to a collection of lines and then drawing the lines by repetitively striking the period, ".".

There are several major disadvantages to generating graphics printouts in serial printers with matrix type fonts by repetitive striking of the period character. First, the period character would wear much more quickly than the other characters. Secondly and equally disadvantageous is the time required to perform graphics printing. Also, software must be present either in the host computer, an interface or the printer to convert the bit addressable data generated by the computer to the vector based line graphics of the printer. As a result, serial printers with matrix type fonts have been less popular than dot-matrix type printers for graphics applications. This is in spite of the fact that the matrix type font printers produce higher quality characters and marks than characters and marks printed by a dot-matrix printer.

In addition to the above noted disadvantages, conventional matrix type font serial printers generate considerable noise when generating graphics printing and require large amounts of energy because the period character has to be struck repeatedly and the line feed mechanism constantly adjusted. As a result of the stress on the period character and the need to strike this character repeatedly to generate a graphics printout, the matrix type font serial printers have tended not to decrease in size or cost where graphics printing capabilities are required.

Accordingly, there is a need for a matrix type font printer and method for printing utilizing a matrix type font printer which generates bit addressable graphics at high speeds, with reduced energy consumption and without undue wear on any one of the character types.

SUMMARY OF THE INVENTION

The invention is generally directed to a serial print element for use with a serial matrix font type printer for printing dot matrix type graphics with the serial matrix font type printer. The invention is also directed to a serial matrix font type printer for printing dot matrix type graphic displays. The invention is further directed to a method of printing dot matrix graphics with a serial matrix font type printer with a print head having a plurality of dot segment type elements.

The print element includes a carrier such as a daisy wheel for holding type elements. The print element includes a plurality of type elements on the carrier for printing dot graphics. The print element includes at least one dot pattern segment series. Each dot pattern segment series is at least two dots long. Alternatively, there are at least two dot pattern segment series and each series is at least one dot long. There is a type element for each printable combination of each dot pattern segment series. As a result, dot matrix type graphics are generated with a serial matrix font type printer.

The printer includes a frame, a platen and a carriage slidably mounted on the frame to allow lateral reciprocating motion with respect to the frame. A serial matrix font type printing head mounted on the carriage includes a mounting assembly for coupling the printing head to the carriage and a carrier for supporting type elements and coupling the printing head to the mounting assembly. A print element is coupled to the carrier member for printing at least graphics images formed of dot patterns. The print element includes at least one dot pattern segment series of at least two dots in length. Each of the dot pattern segment series has a type element on the carrier corresponding to each printable dot pattern combination of the at least two dots in length. a driving mechanism drives the carrier so that a desired type element is located in a printing position in opposition to the platen. As a result, dot matrix type graphics can be printed using a serial matrix font type printer.

The invention is also directed to a method of printing dot matrix graphics with a serial matrix font type printer with a print head having a plurality of dot segment type elements. The method includes receiving a print signal corresponding to a dot segment of a first length. The print signal is then divided into at least one dot segment of a second length at least two dots in length. The print head is then driven so that a dot segment element corresponding to each dot segment of the second length is printed. The print head is then advanced to a next printable position to await receipt of another print signal.

Accordingly, it is an object of the instant invention to provide an improved printer and method for printing which generates and prints bit addressable graphics utilizing a matrix type font serial printer.

Another object of the invention is to provide a matrix type font serial printer and method of printing which is comparable to a dot-matrix printer in character and high-speed graphics printing.

A further object of the invention is to provide a serial printer with a type wheel having dot patterns corresponding to printable bit data supplied by a host computer where the typewheel has a matrix type font with type elements having dots corresponding to bits of data supplied from the host computer, for providing a dot-pattern comparable to that generated by a dot-matrix printer.

Yet another object of the invention is to provide a method of controlling the printing of a serial printer with a matrix type font print wheel including dot patterns corresponding to bit data supplied by a host computer by dividing a print signal supplied from the host computer into n bit segments (n being a natural number) and printing a bit pattern corresponding to the n bits of the signal print.

Still another object of the invention is to provide a printer and method for printing bit addressable graphics on a serial matrix type font printer by dividing each vertical row of the bit addressable graphics printout into one or more segments which are separately printed.

Still other objects and advantages of the invention will in part be obvious and will in part be apparent from the specification.

The invention accordingly comprises the several steps and the relation of one or more of such steps with respect to each of the others thereof, and the apparatus embodying features of construction, combinations of elements and arrangement of parts which are adapted to effect such steps, all as exemplified, in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a table of the ASCII code;

DETAILED DESCRIPTION OF THE PREFERRED EMBODIMENTS

The present invention is directed to serial printers having matrix type fonts and will be described with reference to a daisy wheel printer which is one type of serial printer with a matrix type font. The present invention is, however, also applicable to matrix type font serial printers other than a daisy wheel printer. For example, the present invention is applicable to a typewheel printer or drum printer having a single cylindrical wheel or drum with its outer peripheral surface divided axially and circumferentially into sections each having several types assigned thereto. In addition, the invention is applicable to type-ball printers which have type elements on their spherical surface and are rotatable to strike a selected type element against the paper.

Figure 1:
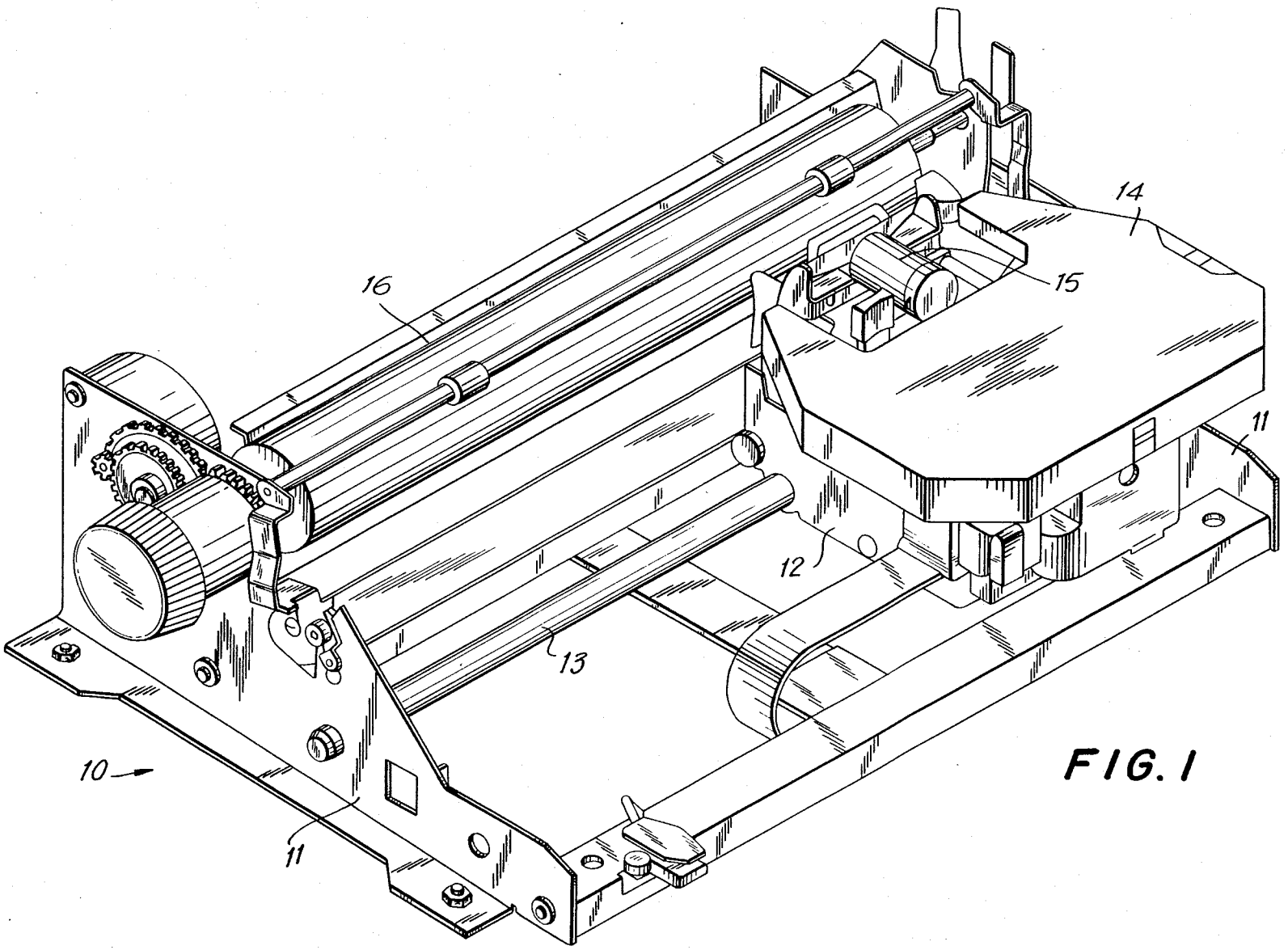
FIG. 1 is a perspective view of a printer constructed in accordance with a preferred embodiment of the invention.

Reference is made to FIG. 1 wherein a printer, generally indicated as 10, is depicted. Printer 10 includes side frames 11 and a carriage 12 which is slidably mounted on a guide 13. A ribbon cassette 14 and a print head 15 are mounted on carriage 12. A platen 16 is mounted between frames 11.

Figure 2:
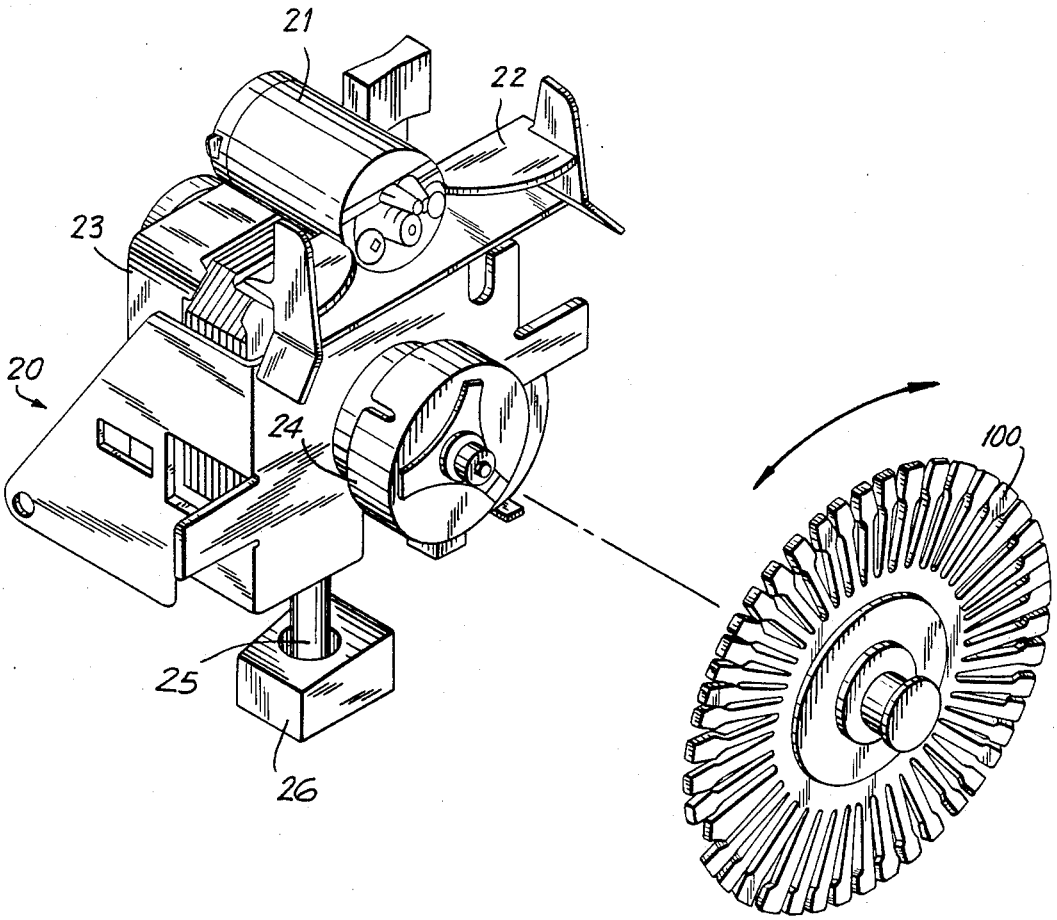
FIG. 2 is a partially exploded perspective view of the print head of the printer of FIG. 1.

Reference is next made to FIG. 2 wherein a printing mechanism constructed in accordance with a preferred embodiment of the invention is depicted. Printing mechanism 20 includes a hammer 21 and a daisy wheel type wheel 100 mounted on a mounting member 22. A wheel motor 23, a type wheel holder 24 and type wheel 100 move up and down on the mounting member under the control of an iron core 25 and solenoid 26 while the hammer is fixed on the carrier. By moving wheel motor 23, type wheel holder 24 and daisy wheel 100 upward, type elements at positions intermediate the type elements at the ends of the spokes and the central portion of daisy wheel 100 are positioned in front of hammer 21 for printing.

A selected type element is struck by hammer 21 which contacts the ribbon of ribbon cassette 14 and causes the type element to be printed on a sheet of paper (not shown) located between platen 16 and ribbon 14. The solenoid is energized in response to a control signal.

Figure 3:
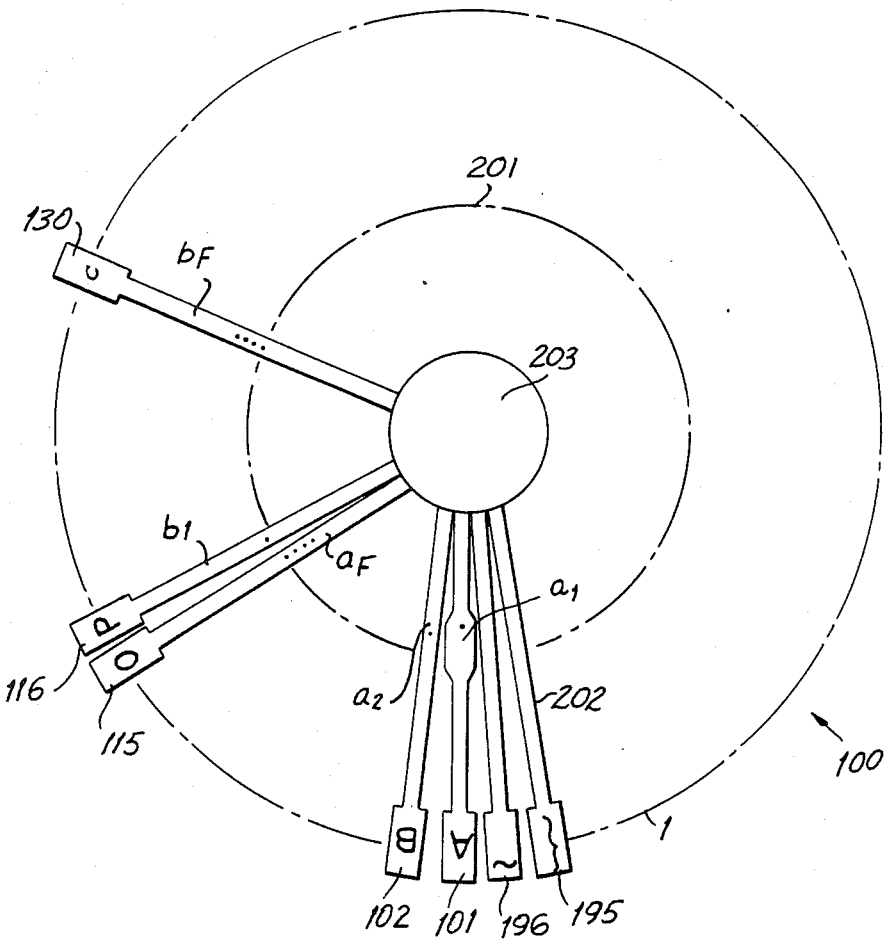
FIG. 3 is a front elevational view of a typewheel having bit patterns constructed in accordance with the invention.

Reference is made to FIG. 3 wherein a portion of a daisy print wheel 100 having a set of type elements 101 through 196 arranged about a circle 201 at the outer ends of spokes, emanating radially from a center 203 for forming a peripheral circle 1 of type characters. Print wheel 100 includes, for example, 94 characters and 2 special characters or symbols as defined by the ASCII convention illustrated in FIG. 4.

As a result, a printer including print wheel 100, is adapted to perform ordinary character printing in exactly the same manner as a conventional daisy wheel printer. However, type-wheel 100 as shown in FIG. 3 also has a series of dot patterns $a_1$ through $a_F$ and $b_1$ through $b_F$ arranged on the spokes 202 associated with type elements 101 through 130. Dot patterns $a_1$–$a_F$ and $b_1$–$b_F$ for graphics printing are positioned substantially mid-way between the center of print wheel 100 and outer circle 1 forming an arc which is a portion of a dot circle 2.

Type elements $a_1$–$a_F$ are the fifteen different dot patterns which include all combinations of four bits which require printing. The sixteenth combination "0000" requires no printing. The dot patterns of type elements $a_1$–$a_F$ correspond to the binary representations of the hexadecimal numbers which are the subscript of the "a" type elements. As an example, the dot pattern for $a_B$ is "1011" (where a "1" represents a dot and an "0" represents no dot). The $a_1$–$a_F$ type elements are printed at the bottom half of the "a" character space. The fifteen type elements $b_1$–$b_F$ likewise include all combinations of four bits which require printing. Type elements $b_1$–$b_f$ are located on spokes 202 outside circle 2 and printed in the upper half of a character space. By combining one "a" type element and one "b" type element, an eight bit data word can be printed. While the present example depicts circular dots, there is no limitation on the shape of the dots. The dots may be square, diamond shaped, oval or any other manner of indicia. However, all of these shapes as well as any others will be referred to as dots.

Figure 5:
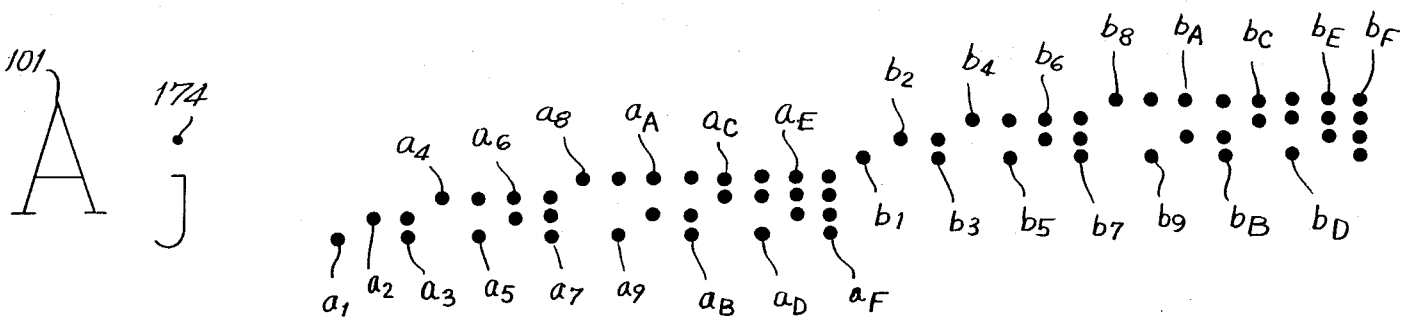
FIG. 5 is a printout showing the bit pattern which can be printed by the typewheel of FIG. 1.

Reference is made to FIG. 5 wherein each of the graphics printing type elements $a_1$–$a_F$ and $b_1$–$b_F$ are depicted. As is seen, type elements $a_1$–$a_F$ correspond to the lower half of the character printing range as shown by comparison to "A", which is type element 101, and "j", which is type element 174. Likewise, type elements $b_1$–$b_F$ correspond to the upper half of the vertical character range. In this example the vertical character range is divided into eight dots. The vertical character range can be divided into more or less dots as particular applications or needs require.

Figure 6A:
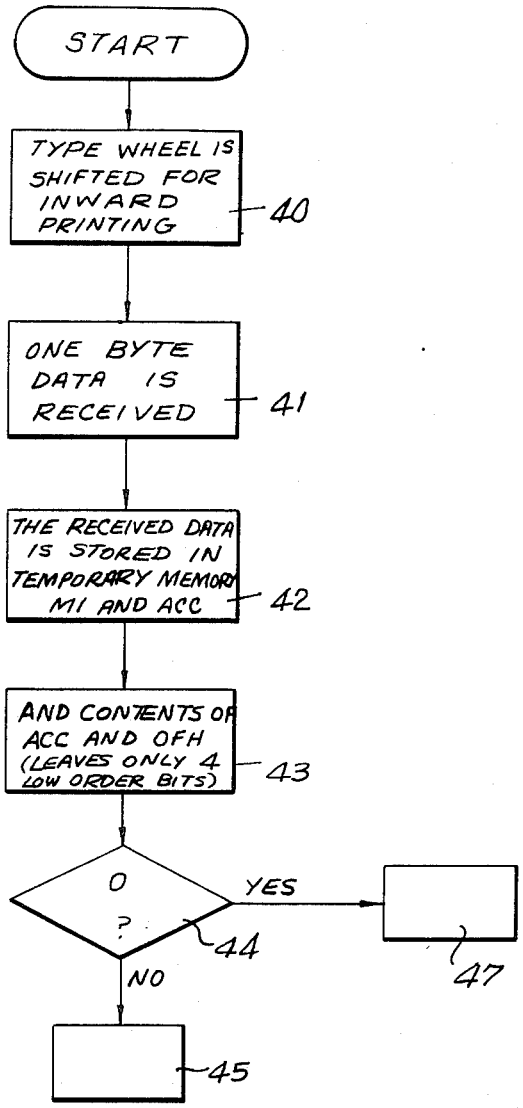
FIGS. 6A, 6B and 6C are flow diagrams of a method for controlling graphic printing in accordance with the present invention.
Figure 6B:
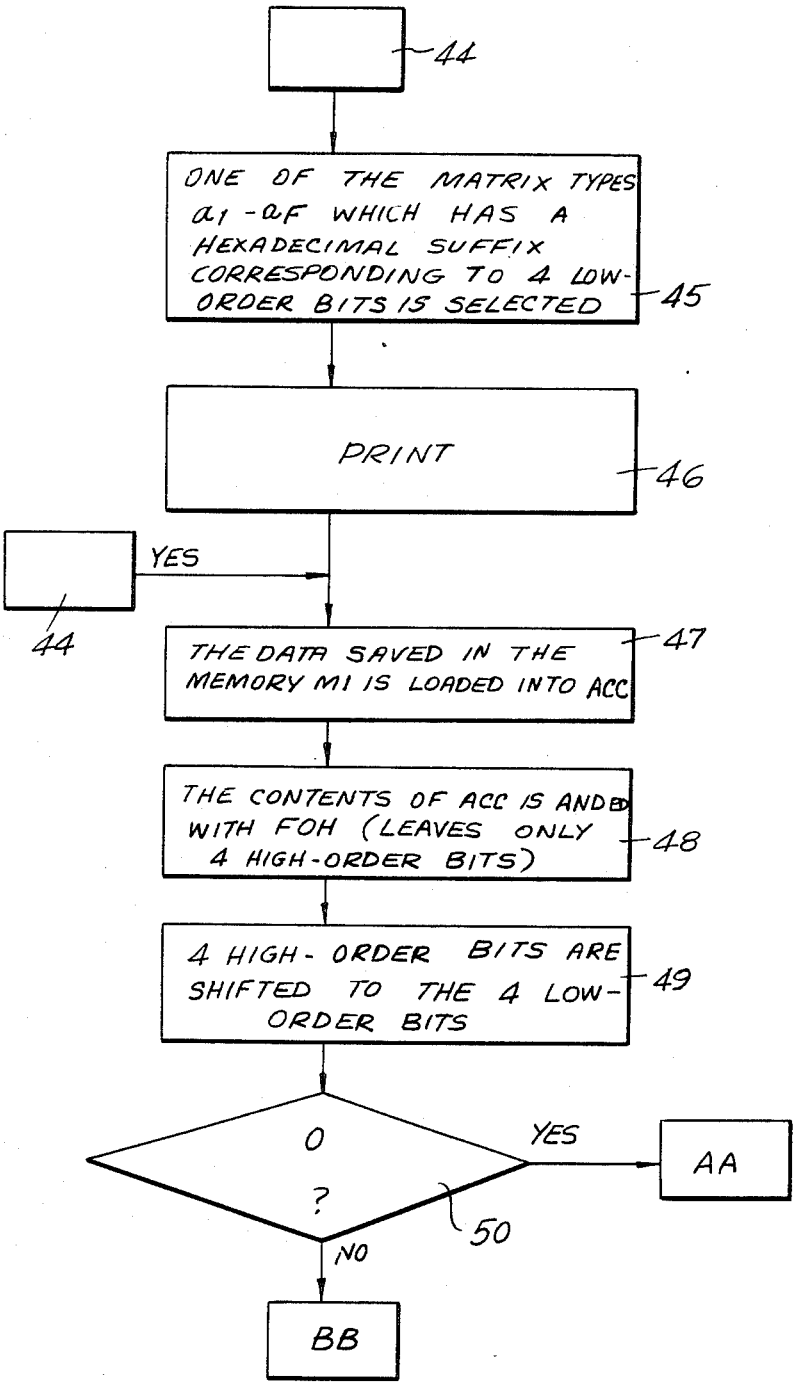
Figure 6C:
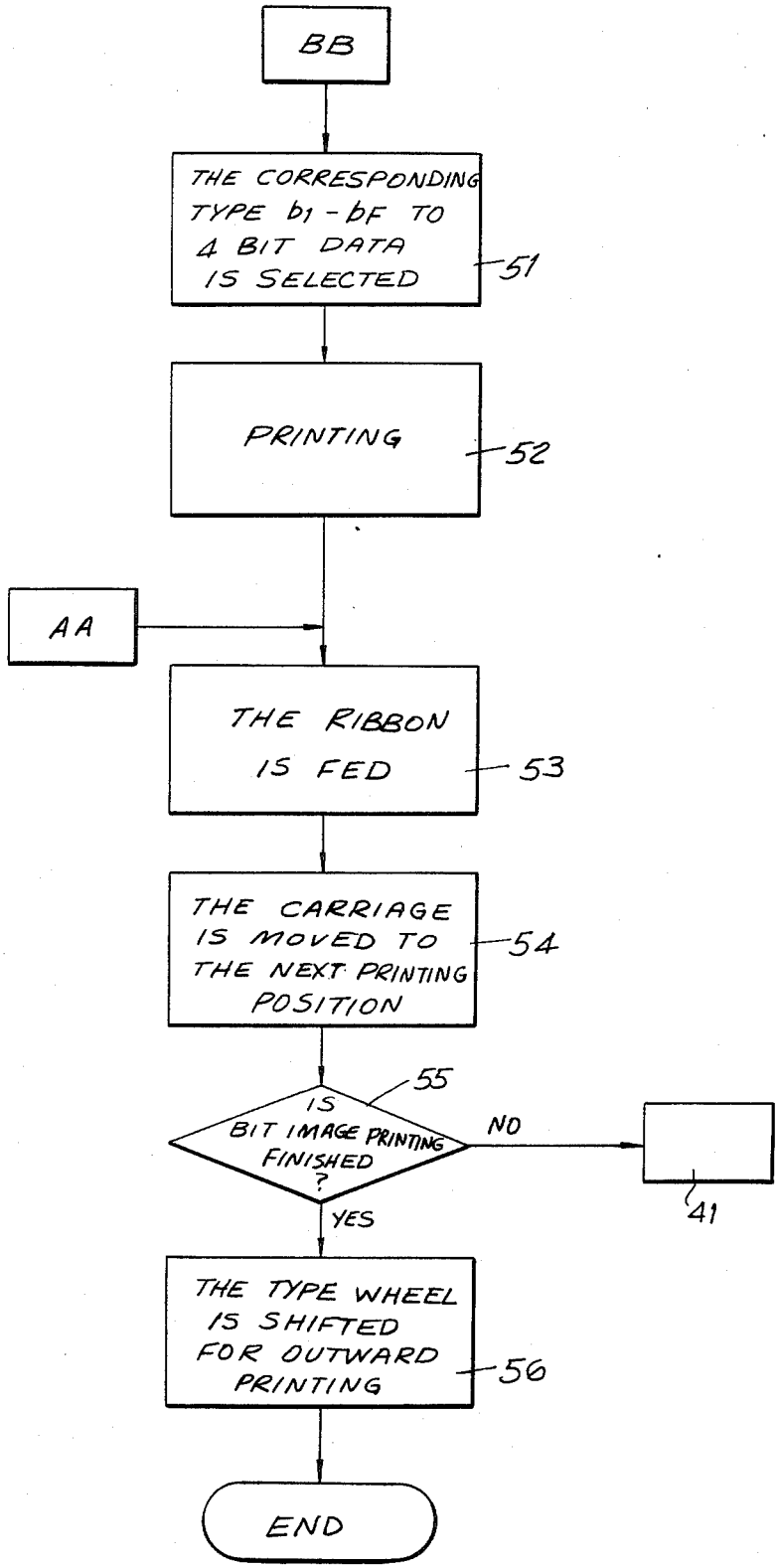

Reference is next made to FIGS. 6A–6C wherein a flow chart of the method for controlling graphics printing with print wheel 100 of FIG. 1 is depicted. Graphics printing is performed in response to print signals generated by a host computer which transfers data items including bit information corresponding to the information stored in the host computer and the dots which are printed out on a dot-matrix printer. The host computer generates a series of vertical bit images corresponding to the desired graphics display. In this embodiment the host computer sends a one byte bit image consisting of eight separately addressable bit locations arranged in a column. A series of these eight bit columns are printed consecutively as the carriage moves accross the page in a horizontal direction. Thereafter, additional lines are printed providing a matrix of dots which generates the graphics.

When the host computer sends a signal to the printer that a bit image is being specified, the printer shifts print wheel 100 as a whole in a step 40 so that inner dot type elements $a_1$–$a_F$ and $b_1$–$b_F$ can print the specified bit image. The shifting of print wheel 100 is conventional in daisy wheel printers and need not be described in any further detail.

Next, printer 10 receives one byte of data from the host computer or from a data buffer intermediate the host computer in a step 41. The received data is stored in an accumulator register ACC for logical operations and also in a temporary memory M1 in a step 42. Next, the contents of register ACC and hexadecimal number OFH are ANDed in a step 43. OFH is a hexadecimal number which is represented in binary form as "0000 1111". Hexadecimal numbers are indicated by a "H" after the number. The result of this ANDing operation is the lower four bits of the byte transmitted from the host computer.

In step 44, the result is examined. If the result is a "zero" this indicates that no bits are to be printed in the lower four bits of the one byte data word and the program jumps to step 47. On the other hand, if the lower four bits are not equal to zero, then printing of the lower four bits is desired and the process advances to step 45.

In step 45, one of the type elements $a_1$–$a_F$ which has a hexadecimal suffix corresponding to the four low-order bits present in register ACC, is selected. In step 46 the selected type element is printed by a usual printing process which ordinarily includes a hammer for impacting the type element which contacts a ribbon and is pressed against a sheet of paper causing the dot pattern to be printed.

Now, whether a bit pattern selected from type elements $a_1$–$a_F$ has been printed or no bit pattern has been printed, in step 47 the one byte data word representative of the eight dot column to be printed is transferred from temporary memory Ml into accumulator register ACC. The data is ANDed with hexadecimal number F0H ("1111 0000" in binary), in step 48. The result of this ANDing operation is to leave only the four higher order bits of the data word present in accumulator ACC. Next, in step 49 the four higher order bits are shifted four spaces so as to be present in the four lower order bits of accumulator ACC.

Figure 7A:
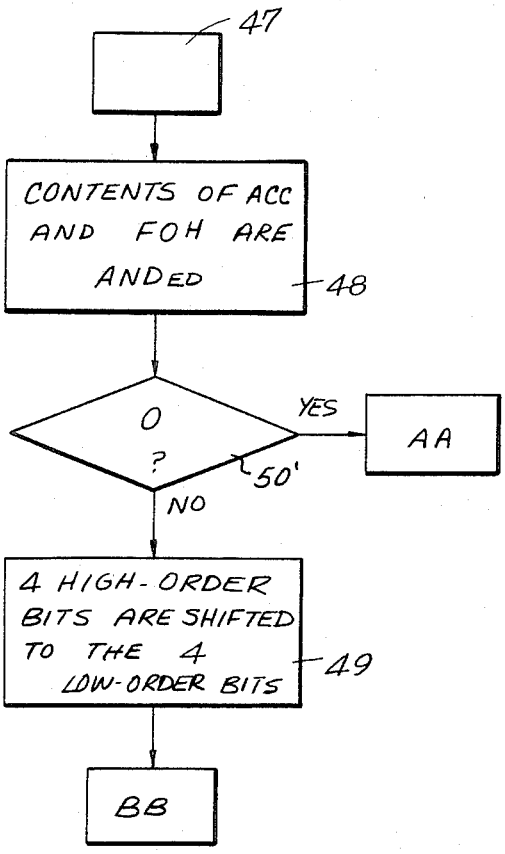
FIGS. 7A and 7B are flow diagrams of alternative methods of controlling a portion of the method depicted in FIGS. 6A, 6B and 6C.
Figure 7B:
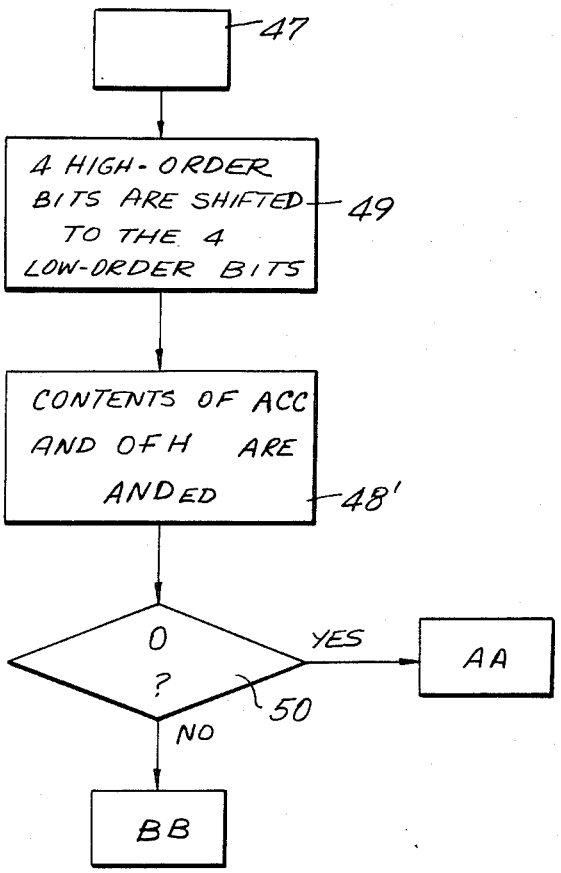

Reference is now made to FIGS. 7A and 7B, wherein alternate approaches to dealing with the four high order bits are depicted. Steps 50 and 49 may be reversed with the four high order bits being shifted to the four low order bits only if they are not equal to zero. This speeds up the operation slightly by relieving the need for rotation of the four high order bits if nothing is to be printed in the four high order dot positions.

In FIG. 7B steps 48 and 49 are reversed with the ANDing operation taking place after shifting the four high order bits present in accumulator ACC, with the same result.

Returning to FIG. 6B, at step 50, the printer determines whether the four high order bits are equal to zero. If these four bits are equal to zero, then the printing associated with the present data word is completed and the program shifts to step 53. On the other hand, if the four high order bits are not equal to zero, additional printing is required and the printer advances to step 51.

In step 51 one of the type elements $b_1$–$b_F$, which has a hexadecimal suffix corresponding to the four high order bits is selected. Thereafter, in step 52, this type element, which contains the dot pattern corresponding to the four high order bits is printed. This completes the printing for the one column, eight bit dot pattern transmitted from the host computer.

In step 53, the printing process having been completed, the ribbon is advanced. The carriage is moved to the next printing position to await the next print command from the host computer in step 54. In step 55, the printer determines if the next character to be printed is a standard ASCII character or if a bit image is to be printed. When the next character to be printed is another bit image control reverts to step 41 to repeat the process of printing the character word in two segments. If the next character is a standard ASCII character, in step 56 print wheel 100 is shifted for printing of the outside type elements 101–196.

If the next data word received from the host computer or data buffer is "zero" ("0000 0000" in binary), no printing is required and the program jumps to step 54 where the carriage is moved to the next printing position in readiness for the next data word.

The process of printing the bit images corresponding to hexadecimal numbers AOH and 59H is described with reference to the process of FIG. 6 and the sequential printing stages depicted in FIG. 8.

Figure 8D:
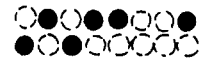
FIGS. 8A, 8B, 8C and 8D are diagrams illustrative of the sequence in which AOH, 59H is printed by the printer utilizing the process in accordance with the invention.
Figure 8C:
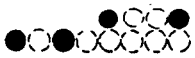
Figure 8B:
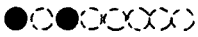
Figure 8A:
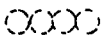

Upon receipt of the bit image signals from the printer the print wheel is shifted in step 40 to allow type elements $a_1$–$a_F$ and $b_1$–$b_F$ to be in position for printing. Received data A0H is loaded into accumulator register ACC and temporary memory M1. Next, the data and hexadecimal number 0FH are ANDed. Since the result is "0000 0000", the program jumps to step 47. As a result, the four lower order bits are not printed (FIG. 8A). Next, A0H which is stored in temporary memory M1 is loaded into register ACC. Then A0H in register ACC ("1010 0000" in binary), and hexadecimal number F0H ("1111 0000" in binary), are ANDed in step 48. A0H is the result and the four high-order bits are shifted to become the four low-order bits. The result in step 49 is 0AH ("0000 1010" in binary). Because the result of the ANDing operation is not "0000 0000", the corresponding matrix type $b_A$ is selected and printed in steps 51 and 52 (FIG. 8B).

The ribbon is fed in step 53 and the carriage is moved one printing position to the right in step 54.

The next data word 59H ("0101 1001" in binary), is received and the process moves from branching step 55 to step 41.

Again, the bit-image data word received from the host computer is loaded into accumulator register ACC and stored in temporary memory M1 (step 42). The result of the ANDing operation in step 43 is 09H and type element $a_9$ is printed in step 45 (FIG. 8C).

In step 47 the data word stored in temporary memory M1 is loaded into accumulator register ACC (here 59H). The result of the ANDing operation in step 48 is 05H ("0000 0101" in binary). As a result, type element $b_5$ is selected in step 51 and printed in step 52 (FIG. 8D).

Thereafter, the ribbon is fed in step 53 and the carriage is advanced one printing position to the right in step 54. Because there are no additional bit-images to be printed, the program leaves the bit-image routine and print wheel 100 is shifted so that type elements 101–196 can be printed (steps 55 and 56).

In the above embodiment, one byte of data represents one vertical row and only thirty of the 96 type spokes are used. However, another thirty of the remaining 66 spokes types may be used so that two byte data from the host computer corresponding to one vertical dot row can be printed. In this case, the vertical row would have sixteen dots. It is also possible to utilize a third set of thirty spokes (using a total of 90 of the 96 spokes) so that 3-byte data from the host computer corresponding to a single vertical dot row may be printed. In this case, the vertical dot row would contain twenty-four dots in each row.

By vertically stacking dot row segments corresponding to each set of four bits transmitted from the host computer and utilizing the 96 spokes available, various configurations are possible. If the length of each dot row segment is kept unchanged, the length of a dot row can be increased by utilizing two byte data which would have a vertical length twice that of one byte data. A finer bit pattern can also be obtained by reducing the spacing between the dots in the vertical bit row. In addition, the dot rows may be made progressively shorter for the second and third bytes. Also, a single print wheel can use thirty spokes for one byte-eight dots per column graphics and sixty spokes for two byte double density-sixteen dots per column graphics. Other combinations are possible limited only by the application for which the printer is suited.

In the embodiment described above, where a one byte data word from the host computer is converted into an eight dot vertical row, only a total of thirty dot patterns are required, that is, fifteen bit patterns for the four high order bits and fifteen bit patterns for the four low order bits. Instead of placing these thirty bit patterns on the spokes of the ASCII character types, they may be placed on the outer periphery of the print wheel substituted for thirty of the ninety-six characters. If this modification is made it becomes unnecessary to include step 40 which shifts the type wheel to print the inner spoke dot patterns. As a result, the printing speed is further increased and the mechanical complexity is reduced.

The above embodiments have been depicted with the number of bits in each dot pattern segment (n) selected to be four. However, the dot pattern segments may be grouped differently. For example, if $n=2$, three dot pattern type elements are required for each two dot segment. Therefore, if a one byte data word is to be printed utilizing this format, only a total of twelve different dot patterns are required (four sets of three type elements). However, instead of a maximum of only two printing operations where $n=4$, a maximum of four printing operations may be required.

If $n=8$, sixty-three different type elements are required to cover all possible dot combinations requiring printing in an eight dot column. This is compared to the thirty type elements required where $n=4$. However, a maximum of only one printing process is required to insure complete printing.

With a printing arrangement constructed in accordance with the invention and printed according to the process of the present invention one-byte data can be processed in two printing operations at a rate approximately four times faster than with a conventional serial matrix font type printer which generates a graphics display utilizing the period punctuation mark. To generate the eight dot vertical display generated by the printing processes in accordance with the present invention, the conventional printer requires up to a maximum of eight printing cycles and eight paper feeding cycles.

In addition, a host computer normally stores data to be displayed on a CRT or printed out on a printer as bits. To print this data by using a series of periods, the data has to be converted into vector representations adding a large software burden on the host computer. However, a printer constructed in accordance with the present invention can use the data stored in the host computer's memory directly, thereby reducing this software burden on the host computer.

Where the bit images are present on the spokes of the daisy wheel character type as described above, up to ninety-six different dot pattern type elements can be used. This allows for considerable flexibility in graphics printing. The ninety-six spokes can be utilized for one-byte data words, two-byte data words, three-byte data words as well as augmented density graphics printing.

In general, serial printers with a matrix type font have been considered poor graphics printers where conventional graphics generation with periods is used. However, the process described above, coupled with the inherent advantages of a matrix type font printer over dot-matrix printers, such as clear printing and better defined characters, provides flexibility comparable to that available with dot-matrix printers and better quality printing. As a result, serial printers constructed in accordance with the invention are suitable for replacing a portion of the market for dot-matrix printers. The serial printer constructed in accordance with the invention consumes less energy and is less expensive to manufacture as a result of the reduced frequency of striking the type elements and feeding paper resulting from the invention. In addition, where the dot patterns for the graphics printing are present on the outer ends of the print wheel spokes, the print wheel is easier to manufacture and the printer does not require a mechanism to shift the print wheel. As a result, even faster printing speeds are achieved.

Accordingly, a matrix type font serial printer which is adapted to print bit addressable graphics without the need for additional software and at greater speeds and with lower energy requirements than previously possible, as a result of the presence of dot pattern type element units on the type wheel is provided.

It will thus be seen that the objects set forth above, among those made apparent from the preceding description, are effeciently attained and, since certain changes may be made in carrying out the above process and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial matrix font type printer for printing dot matrix type graphics displays in response to print data, comprising: a frame; a platen mounted within the frame; a carriage slidably mounted on the frame to allow lateral reciprocating motion with respect to the frame along the platen; and serial matrix printing head means mounted on the carriage, including mounting means for coupling the printing head means to the carriage; carrier means coupled to the mounting means for supporting type elements; print element means operatively coupled to the carrier means for printing at least graphics images formed of dot patterns of a designated length, said print element means including at least two shorter dot pattern segment series, the total length of said shorter dot pattern segment series being equal to the designated length, each of said shorter dot pattern segment series have a series of type elements on the carrier means corresponding to each printable dot pattern combination of the corresponding shorter dot pattern segment series; and driving means for dividing the print data of the designated length into at least two shorter dot patterns segment series and moving said carriage to a desired position along said platen and selecting a desired type element to be in the printing position in opposition to said platen and impacting such type element against said platen and repeating selection of type elements and impaction of such type elements for each type element to be printed at the desired position; the type elements being positioned on the carrier means to avoid overlap when type elements corresponding to different shorter dot pattern segment series are printed at a single desired position; said driving means moving said carriage from said desired position only after each of the type elements to be printed at said desired position are printed; whereby dot matrix type graphics can be printed using a serial matrix font type printer.

2. The printer of claim 1, wherein the print element means further comprises type elements for printing at least a portion of the ASCII characters.

3. The printer of claim 1, wherein there are two dot pattern segment series.

4. The printer of claim 3, wherein each dot pattern segment series is four dots in length.

5. The printer of claim 3, wherein one of the shorter dot pattern segment series corresponds to the upper half of a printing space and the other shorter dot pattern segment series corresponds to the lower half of the printing space.

6. The printer of claim 1, wherein there are n shorter dot pattern segment series, where n is greater than 2, and the printing space is divided into n sections, each of the n sections corresponding to one of the shorter dot pattern segment series.

7. The printer of claim 6, wherein each of the n shorter dot pattern segment series is four dots in length.

8. The printer of claim 2, wherein there are two shorter dot pattern segment series.

9. The printer of claim 8, wherein one of the shorter dot pattern segment series corresponds to the upper half of a printing space and the other shorter dot pattern segment series corresponds to the lower half of the printing space.

10. The printer of claim 2, wherein there are n shorter dot pattern segment series, where n is greater than 2, and the printing space is divided into n sections, each of the n sections corresponding to one of the shorter dot pattern segment series.

11. The printer of claim 1, wherein the carrier means is a daisy wheel having a plurality of spokes extending outward from a central portion.

12. The printer of claim 11, wherein the type elements are located at the ends of the spokes of the daisy wheel.

13. The printer of claim 11, wherein the shorter dot pattern segment series type elements are located at points intermediate the ends of the spokes and the central portion.

14. The printer of claim 2, wherein the carrier means is a daisy wheel having a plurality of spokes extending outward from a central portion.

15. The printer of claim 14, wherein the type elements corresponding to the ASCII characters are located at the ends of the spokes and the type elements corresponding to each of the shorter dot pattern segment series are located on the spokes at points intermediate the ends of the spokes and the central portion.

16. The printer of claim 14, wherein the type elements are located at the ends of the spokes of the daisy wheel.

17. The printer of claim 15, wherein the mounting means further moves the daisy wheel from a first position to a second position and vice versa, said daisy wheel causing the type elements at the ends of the spokes to be printed in the first position and causing the type elements intermediate the ends of the spokes and the central portion to be printed in the second position.

18. The printer of claim 15, wherein there are two shorter dot pattern segment series.

19. The printer of claim 18, wherein one of the shorter dot pattern segment series corresponds to the upper half of a printing space and the other shorter dot pattern segment series corresponds to the lower half of the printing space.

20. The printer of claim 15, wherein the carrier means includes means for moving the daisy wheel printer so as to print the ASCII characters on the ends of the spokes and the dot patterns at points intermediate the ends of the spokes and the central portion of the daisy wheel, and rotating means for rotating the daisy wheel so that a desired type element is in a position for printing.

21. A method of printing dot matrix graphics with a serial matrix font type printer with a print head having a plurality of dot segment type elements in response to print data, comprising:

receiving the print data corresponding to a dot segment of a first length;

dividing the print data of the first length into at least two shorter dot segments, the total length of the shorter dot segments equalling said first length;

driving the print head so that a dot segment type element corresponding to each printable shorter dot segment is printed without advancing the print head to a next printable position; and advancing the print head to the next printable position to await receipt of another print signal.

22. The method of claim 21, wherein in print signal was divided into two shorter dot segments of a second length.

23. The method of claim 22, wherein the first length is eight dots long and the second length is 4 dots long.

24. The method of claim 21, wherein the print signal is divided into at least three shorter dot segments.

25. The method of claim 21, wherein a printing space which corresponds to a physical location where the print signal is to be printed is divided into a number of ranges equal to the number of shorter dot segments.

26. The method of claim 25, wherein the print head is separately driven for shorter dot segment type elements adapted to print in different ranges of the printing space.

27. The method of claim 21 further comprising determining whether a print signal corresponds to a dot matrix graphics signal or an ASCII character and printing the ASCII character when the print signal indicates that ASCII character printing is selected.

28. The method of claim 27, wherein a printing space which corresponds to a location where the print signal is to be printed is divided into a number of ranges equal to the number of shorter dot segments.

29. The method of claim 28, wherein the print head is separately driven for dot segment type elements adapted to print in different ranges of the printing space.

30. The method of claim 27, wherein the print head is a daisy wheel having the ASCII characters on the ends of the daisy wheel spokes and having the dot segment type elements at points intermediate the ends of the spokes and the center of the daisy wheel, said daisy wheel being driven so that the ASCII characters are printed upon receipt of a character print signal and the dot segment elements are printed upon receipt of a print signal corresponding to a dot segment of the first length.

31. The method of claim 30 further comprising moving the print head when a dot segment print signal is received to print the dot segment type elements.

* * * * *